US007028358B2

(12) United States Patent
Liu

(10) Patent No.: US 7,028,358 B2
(45) Date of Patent: Apr. 18, 2006

(54) WIDTH-ADJUSTABLE ALTERNATING AIR INFLATION MATTRESS

(76) Inventor: Tsung His Liu, 235 Chung - Ho Box 8-24, Taipei (TW)

( * ) Notice: Subject to any disclaimer, the term of this patent is extended or adjusted under 35 U.S.C. 154(b) by 0 days.

(21) Appl. No.: 10/634,670

(22) Filed: Aug. 6, 2003

(65) Prior Publication Data

US 2004/0255386 A1 Dec. 23, 2004

(30) Foreign Application Priority Data

Jun. 18, 2003 (TW) ..... 92116488 A

(51) Int. Cl.
*A47C 27/10* (2006.01)

(52) U.S. Cl. ..... 5/710; 5/713

(58) Field of Classification Search ..... 5/706, 5/710, 713, 739, 708, 715
See application file for complete search history.

(56) References Cited

U.S. PATENT DOCUMENTS 5,065,464 A * 11/1991 Blanchard et al. ..... 5/715
5,421,044 A * 6/1995 Steensen ..... 5/710
5,708,999 A * 1/1998 Priolo et al. ..... 5/708
5,956,787 A * 9/1999 James et al. ..... 5/713
6,079,070 A * 6/2000 Flick ..... 5/715
6,282,735 B1 * 9/2001 Stolpmann et al. ..... 5/606
6,604,252 B1 * 8/2003 Lee et al. ..... 5/715
6,739,001 B1 * 5/2004 Flick et al. ..... 5/710
2002/0133883 A1 * 9/2002 Perez et al. ..... 5/713

* cited by examiner

*Primary Examiner*—Michael Safavi

(57) ABSTRACT

A width-adjustable alternating air inflation mattress has a body. At least one lateral side of the body is added with tubular air cells for increasing the width of the bed body. The inflation of the tubular air cell is controlled by air valves. When the tubular air cells are inflated, the width thereof is increased. By above mentioned alternating air inflation mattress, in normal use, the alternating air inflation mattress has a sufficient wide and thus the patient can lie upon the bed comfortably. If it is desired to pass the alternating air inflation mattress through the door, it only needs to evacuate airs in tubular air cells at two sides of the bed to reduce the width of the bed. Other than the inflation of the tubular air cells being controllable, if the patent needs a first aid, the air in the tubular air cell can be evacuated out rapidly for executing CPR.

3 Claims, 19 Drawing Sheets

WIDTH-ADJUSTABLE ALTERNATING AIR INFLATION MATTRESS

BACKGROUND OF THE INVENTION

1. Field of the invention

The present invention relates to alternating air inflation mattresses system, and particularly to a width-adjustable alternating air inflation mattress having a extendable mattress body, wherein at least one lateral side of the body being added with tubular air cells for increasing the width of the mattress body, the inflation of the tubular air cell being controlled by air valves from control units. When the tubular air cells are inflated, the width of the mattress body is increased so that the mattress can easy get into a narrow door in movement and meet different weight patients.

2. Description of the Related Art

The prior art bed is not suitable for patients which need to lie on the bed for a long time because they often cause pressure ulcer, even the skins of the patients is necrosis. To solve this problem, an alternating air inflation mattress system is developed, which is formed by a multi tubular air cells. The tubular air cells can be inflated air or evacuated air alternatively (alternating) so as to buffer the pressures upon the skins and muscles. Thereby, air ventilation is improved on the air cells.

In the prior art, the widths of the alternating air inflation mattresses are fixed size, for example, with a size of 36 inches. However, it is not suitable for the bariatric patient. Although increasing the width of the alternating air inflation mattress can improve this problem, but it will induce that the width of the alternating air inflation mattress is wider than the door so that it can not pass through the door as the bed is moved. Thereby, in emergency, if the patient lay on the alternating air inflation mattress and need to move to other room for treating or rehabilitation, the alternating air inflation mattress cannot pass through the door. Thus, apparently, to widen the alternating air inflation mattress is not a preferred way. Moreover, to have different widths of the alternating air inflation mattresses, a hospital must prepare a plurality of mattresses of different widths. Thus the cost is increased.

SUMMARY OF THE INVENTION

Accordingly, the primary object of the present invention is to provide a width-adjustable alternating alternating air inflation mattress having an extendable body; at least one lateral side of the body being added with tubular air cells for increasing a width of the mattress body. The inflation of the tubular air cell is controlled by air valves from control unit. When the tubular air cells are inflated, the width of the mattress body is increased from both sides.

By above mentioned alternating air inflation mattress, in normal use, the alternating air inflation mattress has a sufficient wide and thus the patient can lie upon the mattress comfortably. If it is desired to pass the alternating air inflation mattress through the door, it only needs to evacuate airs from both sides of tubular air cells so as easy to reduce the width of the mattress.

In the air valve of the present invention, Other than the inflation of the tubular air cells being controllable, if the patient needs a first aid, the air in the tubular air cell can be evacuated out rapidly for executing CPR.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1A:
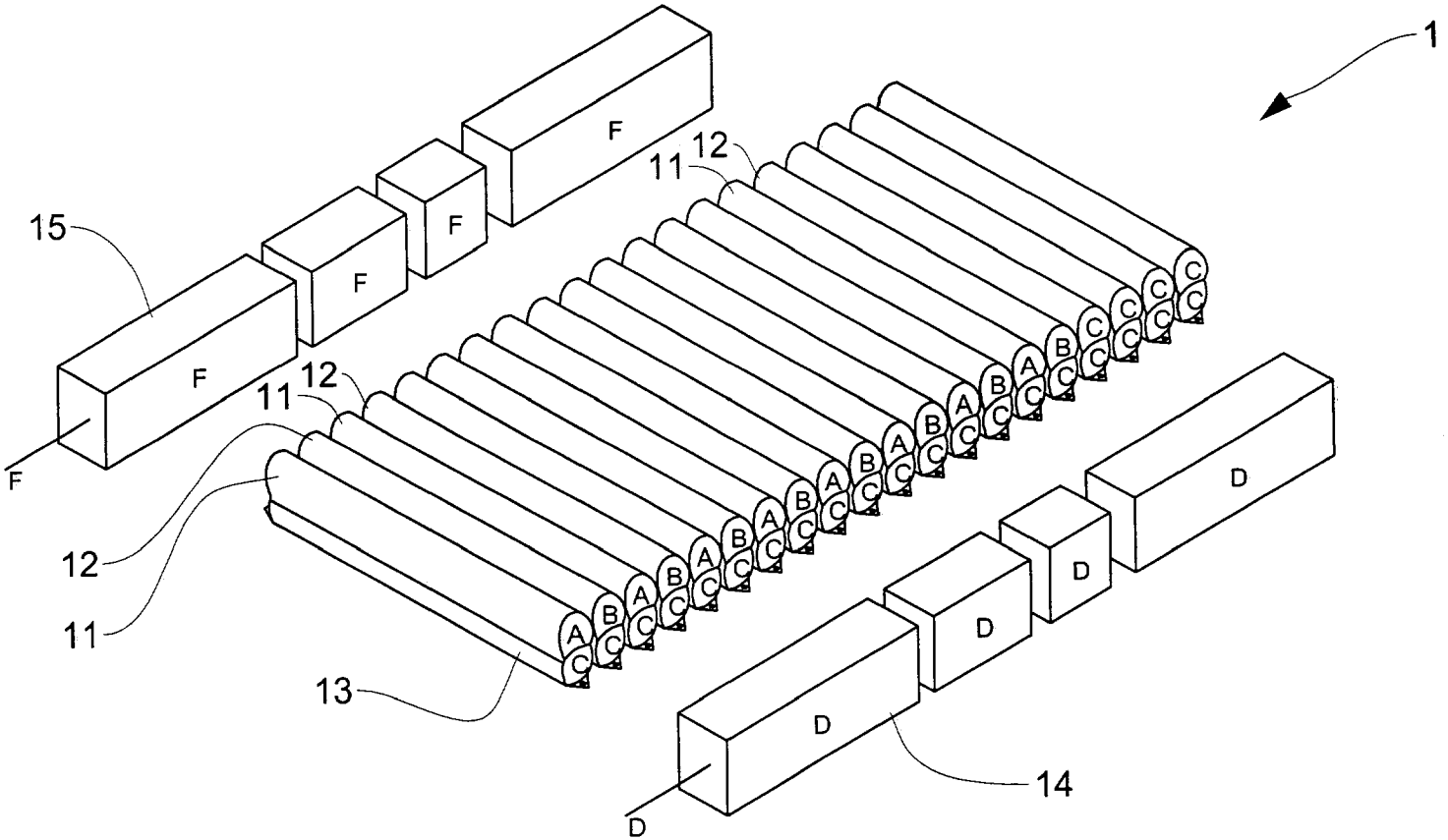
FIG. 1A is a schematic perspective view of the alternating air inflation mattress of the present invention.
Figure 1B:
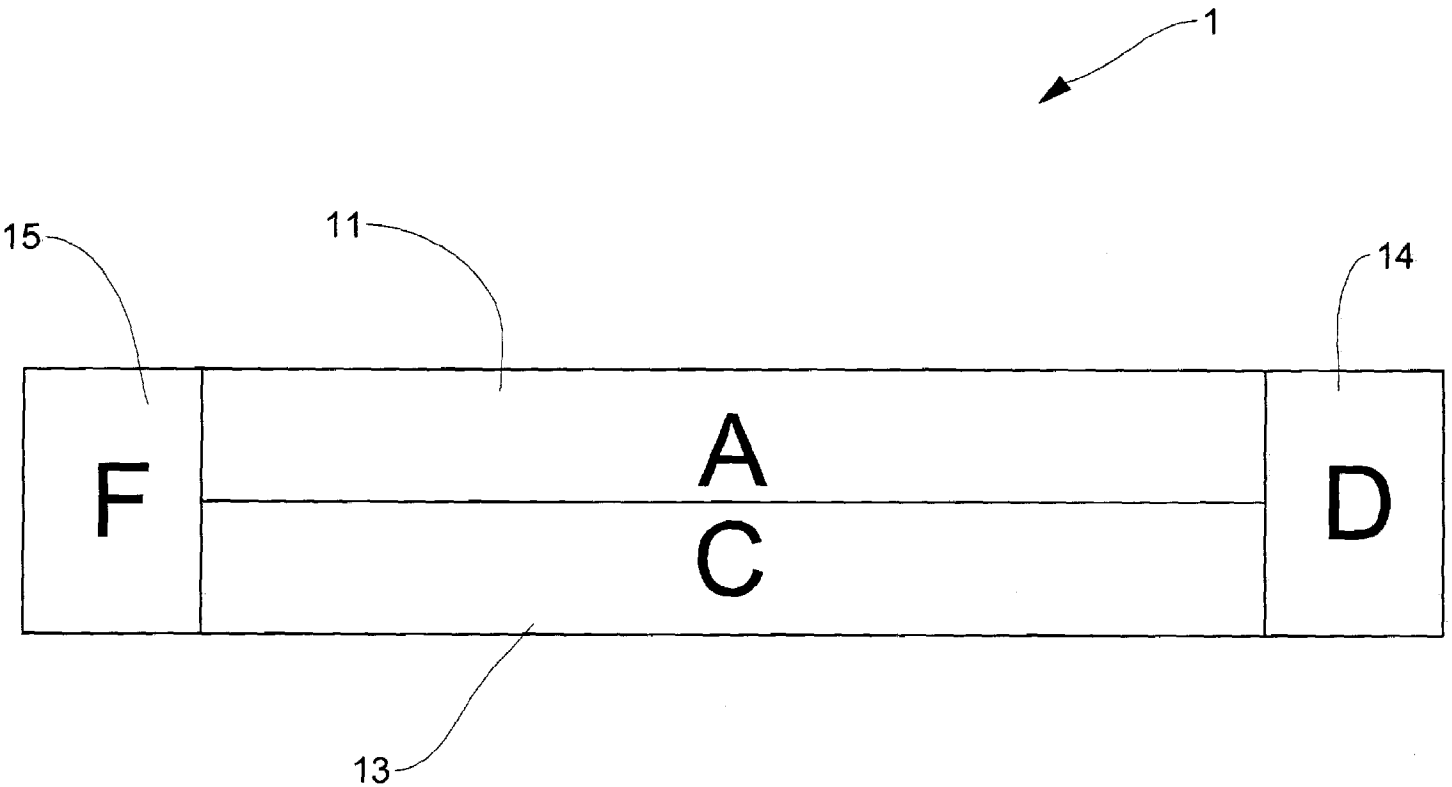
FIG. 1B is a lateral schematic view of the alternating air inflation mattress of the present invention.
Figure 1C:
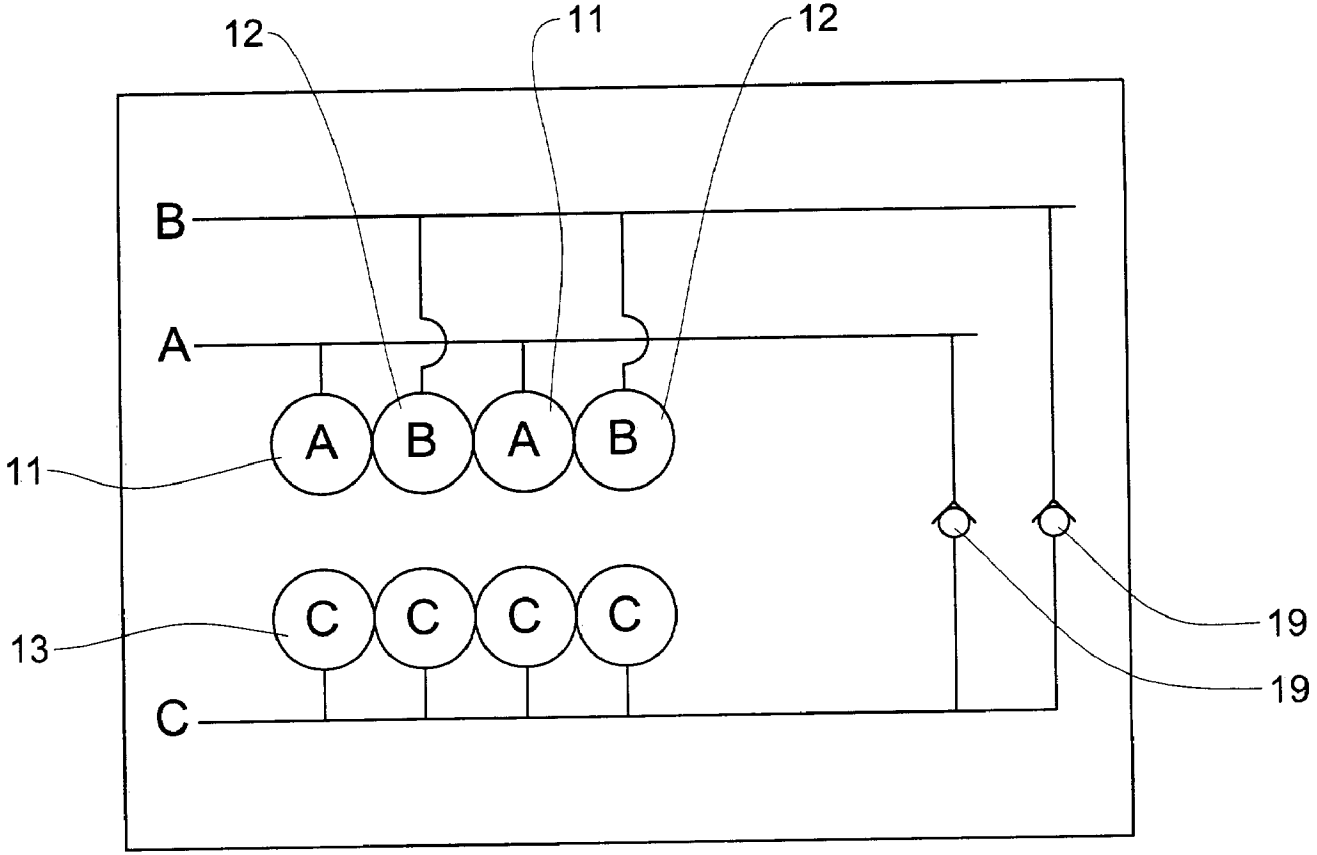
FIG. 1C is a schematic view showing that the alternating air inflation mattress of present invention is arranged with a check valve.

Referring to FIGS. 1A and 1B, the width-adjustable alternating air inflation mattress of the present invention is illustrated. The width-adjustable alternating air inflation mattress of the present invention is a mattress body 1. The mattress body 1 includes a plurality of alternating tubular air cells 11, a plurality of alternating tubular air cells 12 and a plurality of non alternating/static tubular air cells 13 which are adjacently arranged in parallel. Two ends of the tubular air cells 11, 12 and 13 are arranged with tubular air cells 14 and tubular air cells 15, respectively. The tubular air cells 11 and tubular air cells 12 could be static function or alternating function. In normal powerless condition and in powerless transport condition, the tubular air cells 13 will remain inflated through the sealing of check valve 19 (see FIG. 1C)*and* the sealing plate 387 (see FIG. 3B)located at the first air valve 3. The tubular air cells 11, 12 and 13 are used as a base. The inflation of tubular air cells 14 and 15 are determined by the width of the width-adjustable alternating air inflation mattress.

Figure 2:
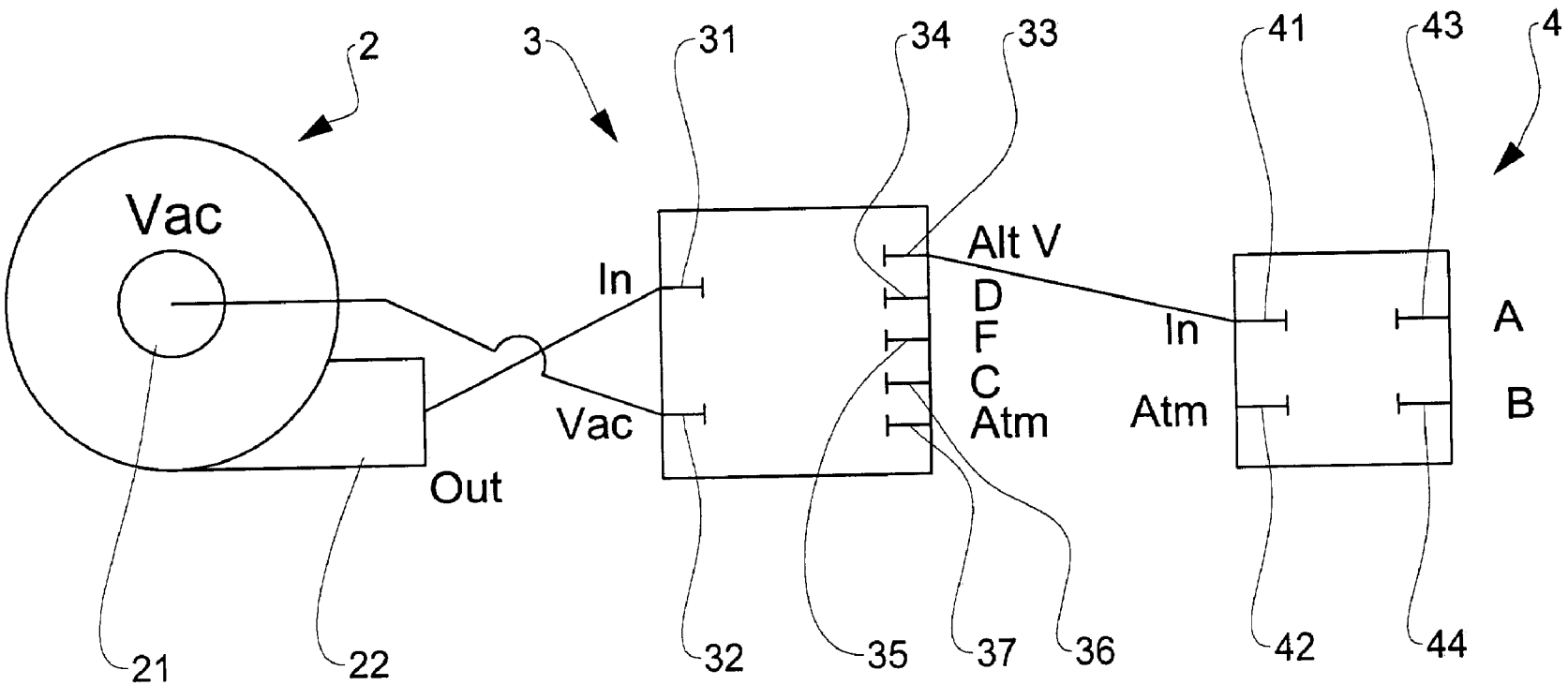
FIG. 2 shows the arrangement of the pump, the first air valve and second air valve of the present invention.

Referring to FIGS. 2, the arrangement of the present invention is illustrated. The inflation and evacuate of air in the tubular air cells can be achieved by a pump/blower 2, a first air valve 3 and a second air valve 4.

The pump/blower 2 includes an air suction 21 and an air outlet 22 which is communicable with the first air valve 3.

The first air valve 3 is connected between the mattress body 1, pump 2 and second air valve 4. The first air valve 3 includes a first air inlet 31, an air supply 32, an air transfer tube 33, connecting tubes 34, 35, and 36, and a first opening 37. The first air inlet 31 is connected to the wind outlet 22. The air supply opening 32 is connected to a wind suction 21. The connecting tube 34 is connected to the tubular air cells 14. The connecting tube 35 is connected to the tubular air cells 15. The connecting tube 36 is connected to the tubular air cells 13. The first opening 37 is opened.

The second air valve 4 is installed between the first air valve 3 and the mattress body 1 for alternatively inflating and evacuating air in the tubular air cells 11 and tubular air cells 12. The second air valve 4 includes a second air inlet 41, a second opening 42, a connecting tube 43, a connecting tube 44, etc. The second air inlet 41 is connected to the air transfer tube 33. The second opening 42 is opened and the connecting tubes 43 and 44 are communicable to the tubular air cells 1 and 12, respectively.

Figure 3B:
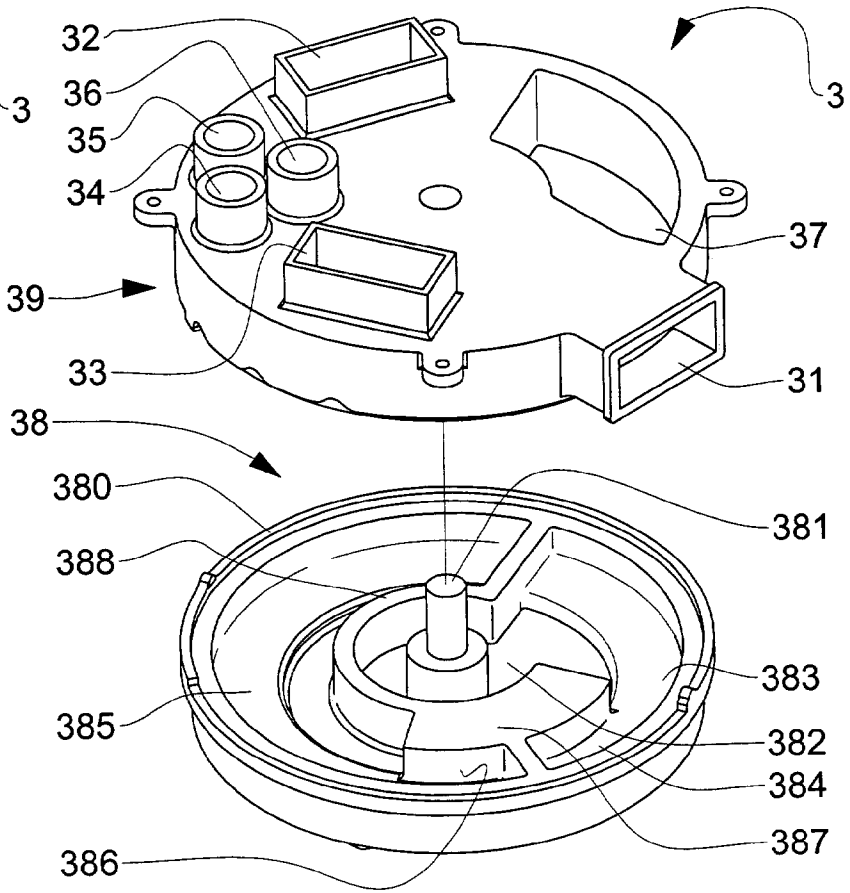
FIG. 3B is another exploded perspective view of the first air valve of the present invention.
Figure 3A:
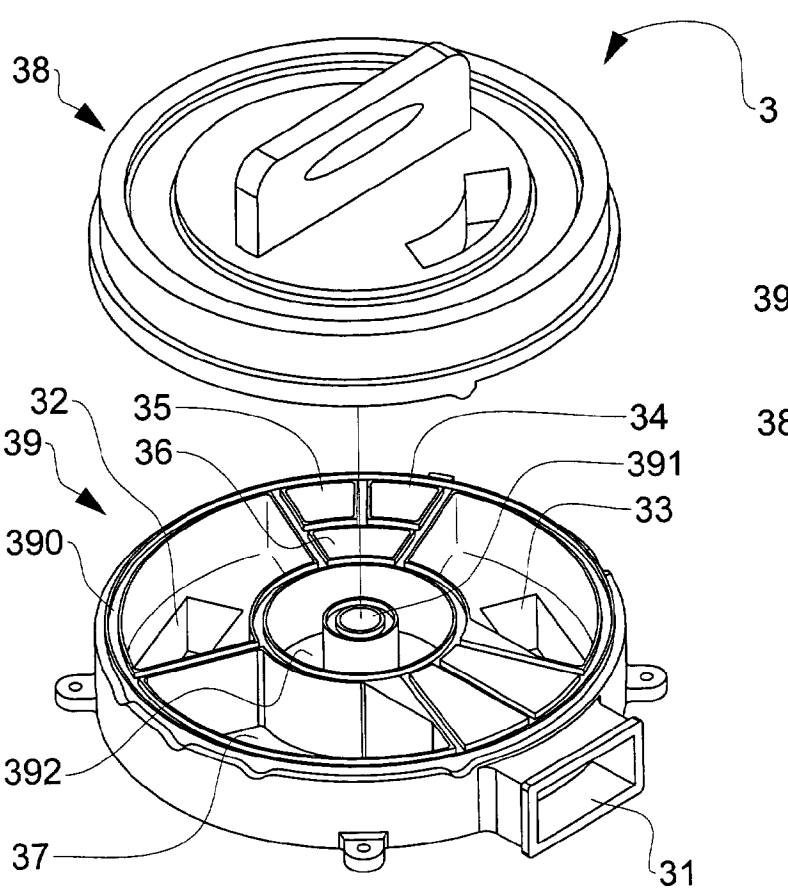
FIG. 3A is an exploded perspective view of the first air valve of the present invention.

Referring to FIGS. 3A and 3B, the embodiment of the first air valve 3 is illustrated The first air valve 3 is formed by a first upper body 38 and a first lower body 39. The first upper body 38 has an annular edge 380 at an inner side thereof, and a center of the first upper body 38 is installed with a center space 382, a space 383, a space 384, and space 385, space 386, sealing plate 387, etc. The edge of the first lower body 39 is formed with an annular edge 390, a central hole 391, a lower center space 392, the first air inlet 31, the air supply opening 32, the air transfer tube 33, the connecting tube 34, the connecting tube 35, the connecting,tube 36 and the first opening 37, etc. The interior of the first air inlet In 31 is communicable to the lower center space 392.

Figure 4B:
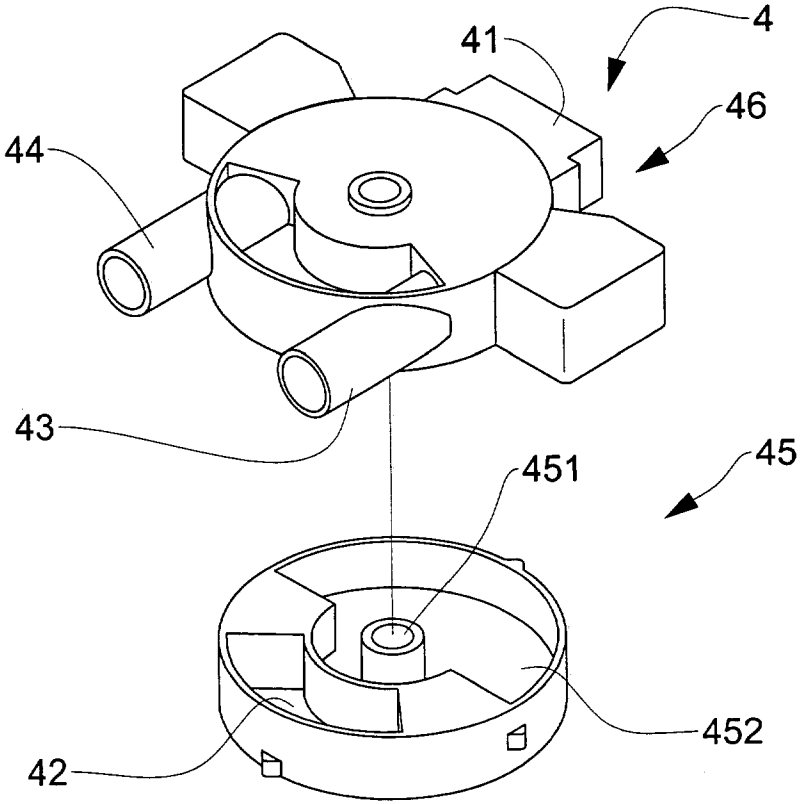
FIG. 4B is another exploded perspective view of the second air valve of the present invention.
Figure 4A:
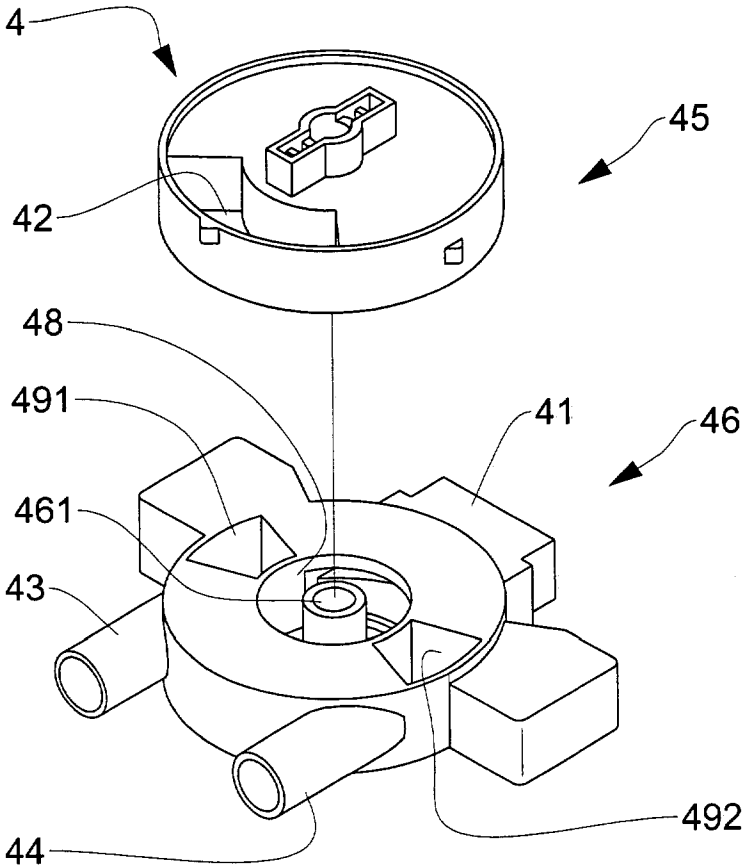
FIG. 4A is an exploded perspective view of the second air valve of the present invention.

With reference to FIGS. 4A and 4B, the structure of the second air valve 4 is illustrated. The second air valve 4 is formed by a second upper body 45 and a second lower body 46 which are overlapped to one another. The inner center of the second upper body 45 is formed with a shaft 451 and an edge thereof is formed with a space 452 and a second opening 42. The second lower body 46 includes a second air inlet 41, a connecting tube 43, a connecting tube 44, a shaft 461, a central space 48, a space 491, a space 492, etc. An interior of the second air inlet 41 is communicable to the central space 48. The space 491 is communicable to the connecting tube 43. The space 492 is communicable to the connecting tube 44.

Figure 5B:
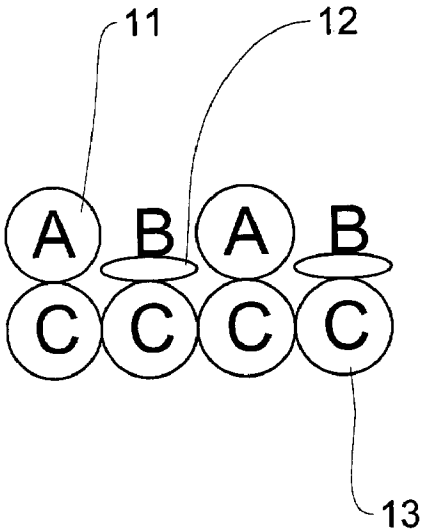
FIG. 5B is a schematic view of the alternating air inflation mattress in FIG. 5A.
Figure 5A:
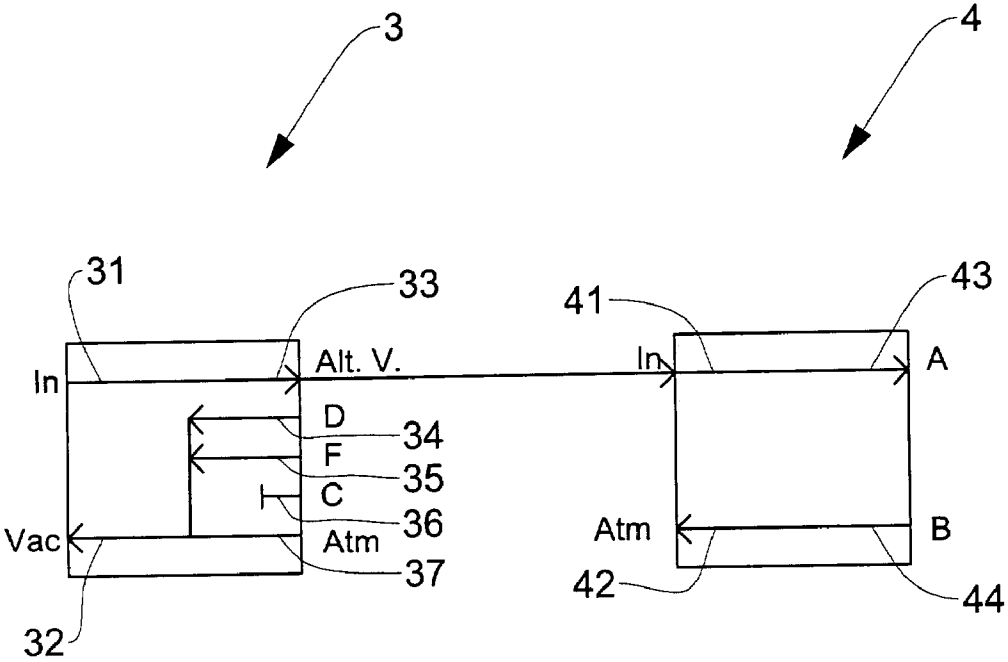
FIG. 5A shows the arrangement of the present invention, where the mattress body is in a basic width and air in one tubular air cell is evacuated.
Figure 5C:
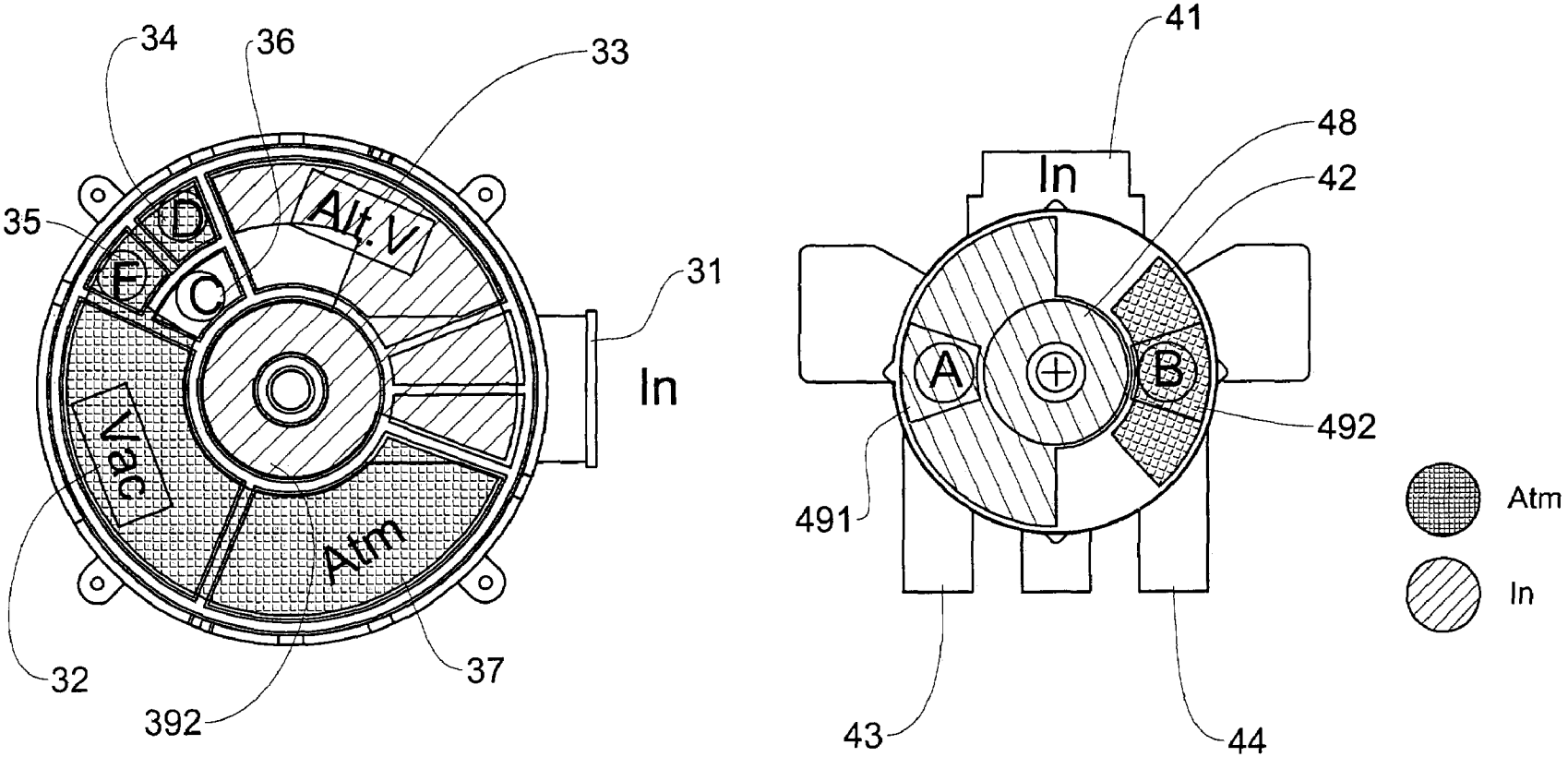
FIG. 5C is a schematic view showing the first air valve and second air valve FIG. 5A.

By above said structure, when it is desired that the alternating air inflation mattress has a basic width, referring to FIGS. 5A, 5B and 5C, the first upper body 38 of the first air valve 3 rotates with respect to the first lower body 39 to a specific orientation as illustrated in the figures. The first inlet 31 is communicable to the air transfer tube 33 by the lower central space 492, upper central space 382, and space 383. The air supply opening 32 sucks air from the connecting tubes 34 and 35 and the first opening 37. The tubular air cells 14, 15 are not inflated. The air transfer tube 33 is inflated for supplying air to the second air valve 4. Then, the second upper body 45 of the second air valve 4 rotates with respect to the second lower body 46 to a specific orientation. Air flows into the air inlet 41, passing through the central space 48, and the space 452 to the space 491 and connecting tube 43. Then the tubular air cell 11 is inflated. The air in the tubular air cell 12 is vented out since the connecting tube 44 is communicable to the space 492 and the second opening 42. Since the inflated tubular air cell 13 is covered by the sealing plate 387, it is retained in the original condition.

Figure 6B:
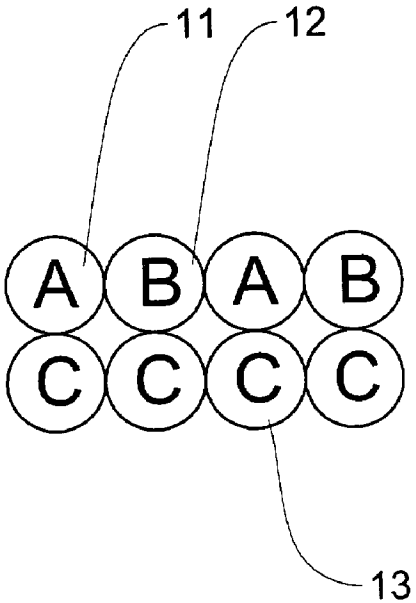
FIG. 6B is a schematic view showing the alternating air inflation mattress of FIG. 6A.
Figure 6A:
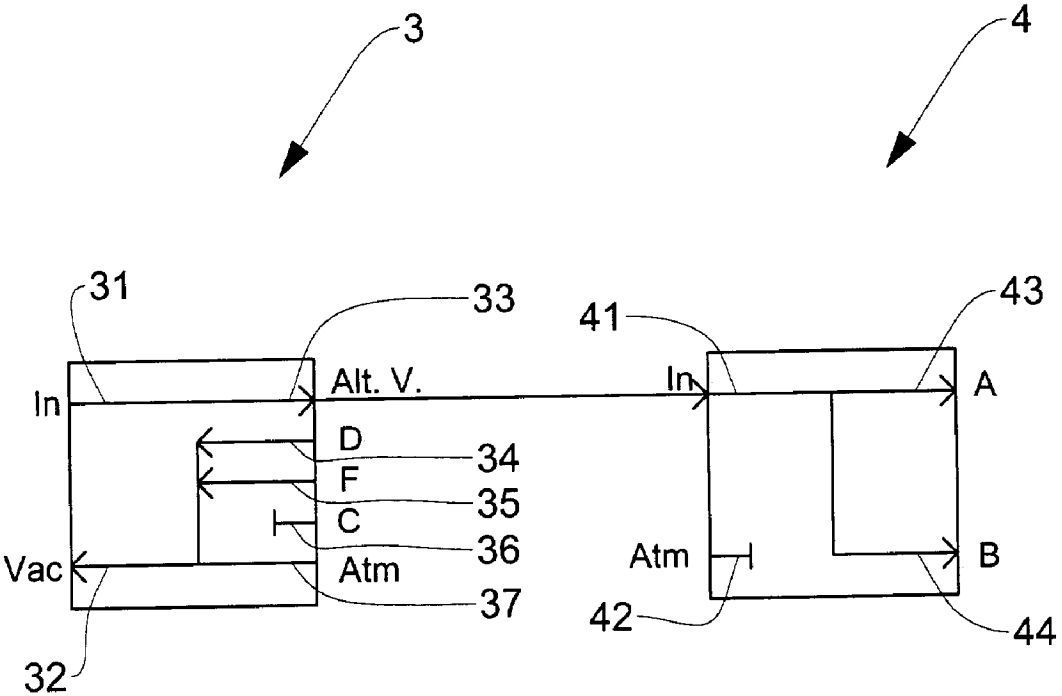
FIG. 6A shows one arrangement of the present invention, where the alternating air inflation mattress is in a basic width and two tubular air cells are inflated.
Figure 6C:
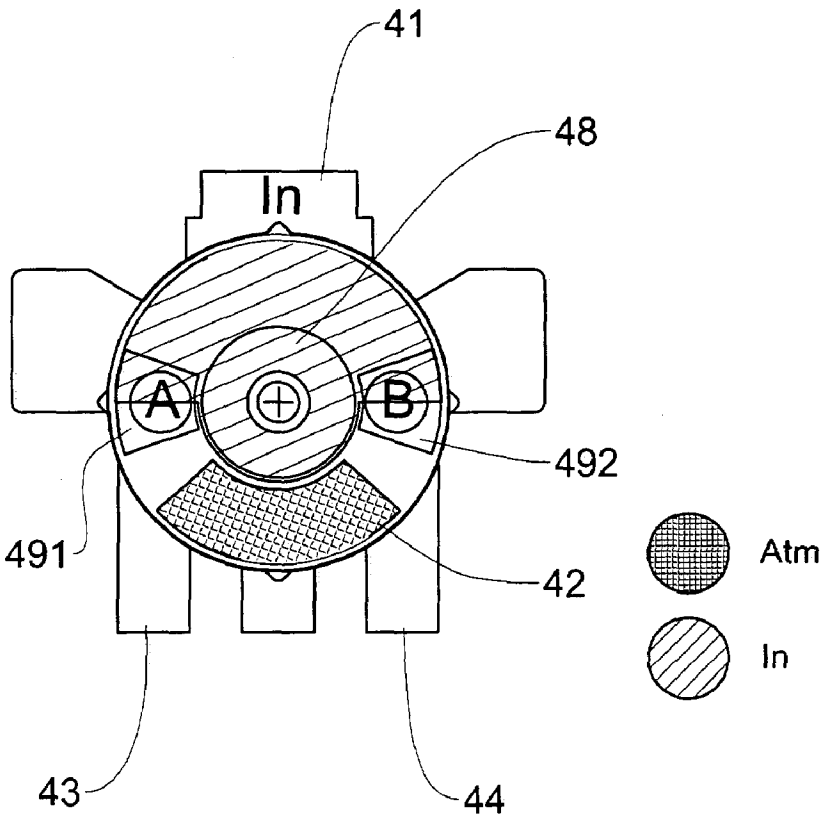
FIG. 6C is a schematic view showing the first air valve and the second air valve of the FIG. 6A.
Figure 6C:
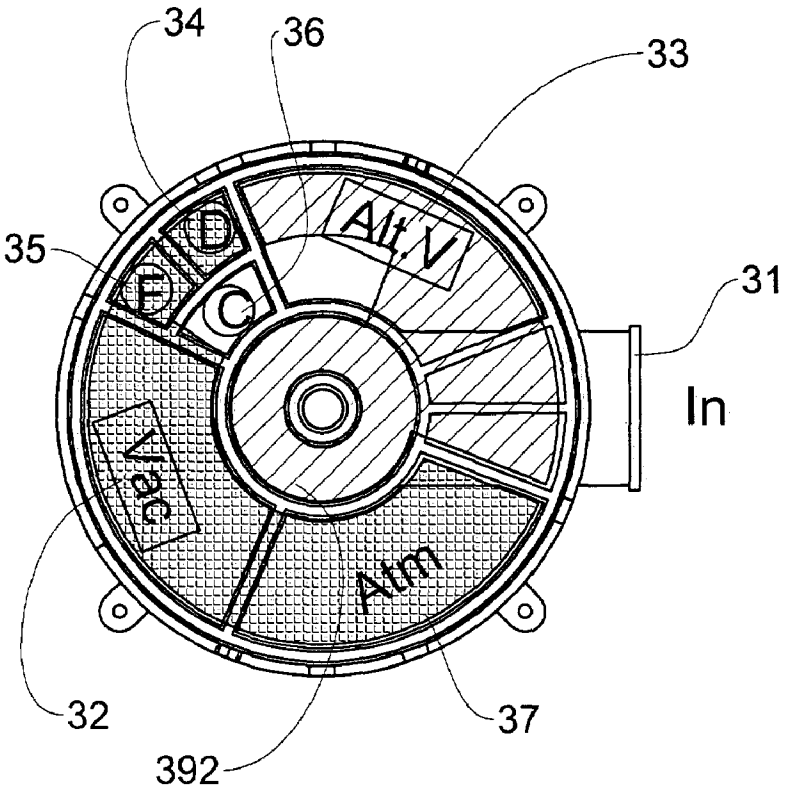

Referring to FIGS. 6A, 6B and 6C, the first air valve 3 is retained in the previous. The second upper body 45 of the second air valve 4 rotates with respect to the second lower body 46 to a specific orientation as shown in the drawings. As a result, air flows into the second air inlet 41, passing through the central space 48, and the space 452 to the space 491, space 492, and the connecting tubes 43, 44. At this state, the tubular air cells 11 and 12 are both inflated.

Figure 7B:
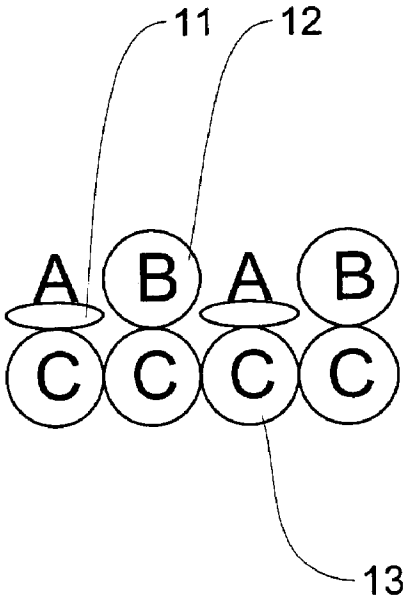
FIG. 7B is a schematic view showing the alternating air, inflation mattress of FIG. 7A.
Figure 7A:
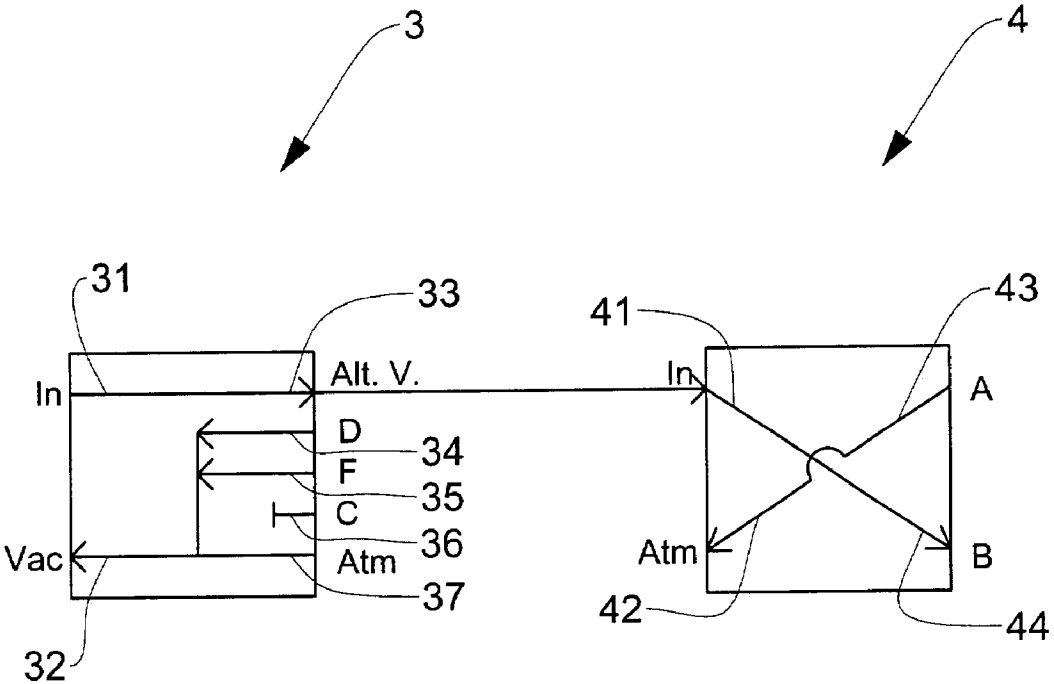
FIG. 7A shows the arrangement of the present invention, where the alternating air inflation mattress is in basic width, air in the tubular air cell is evacuated.
Figure 7C:
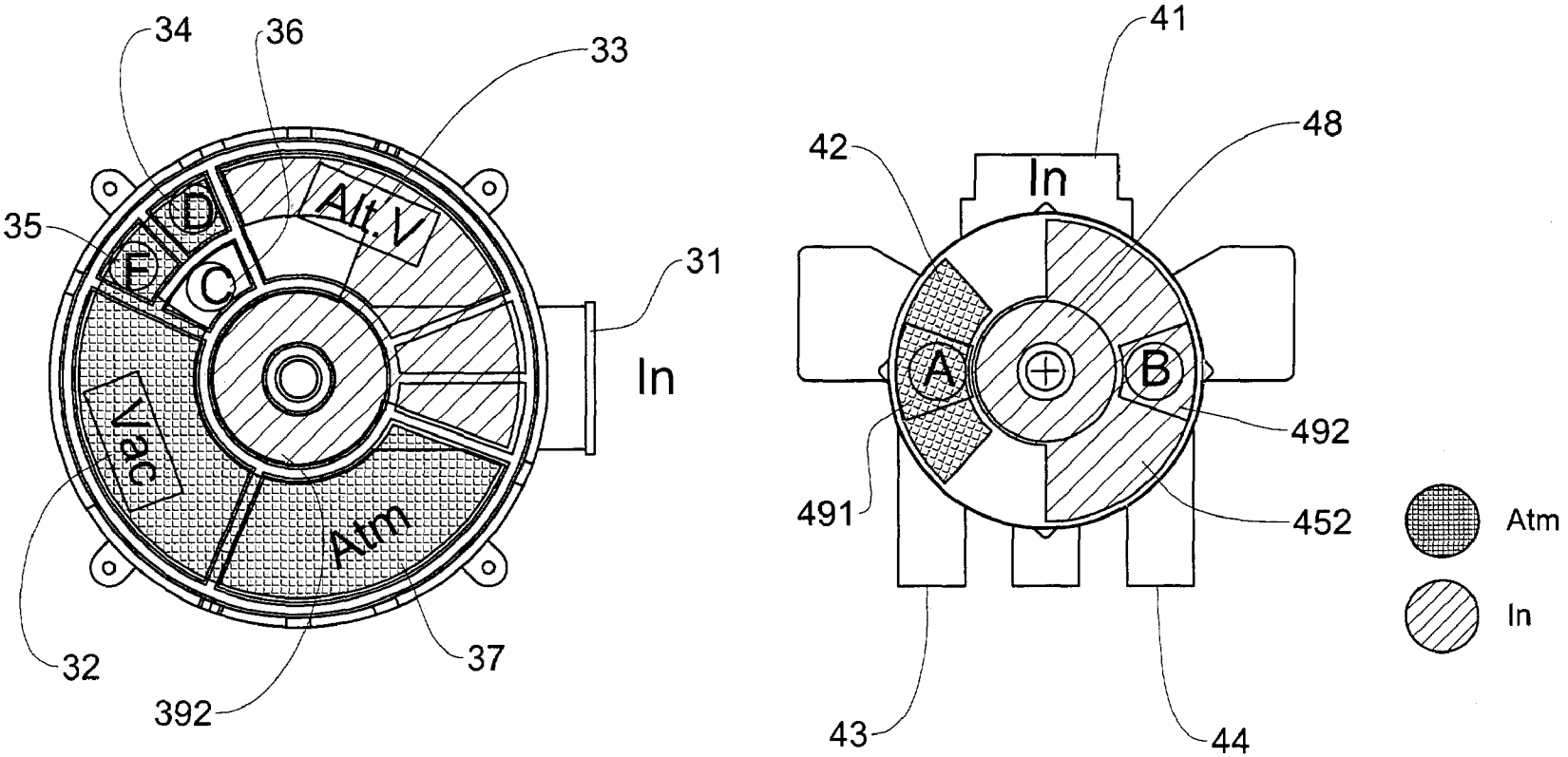
FIG. 7C is a schematic view showing the first air valve and the second air valve of the FIG. 7A.

Referring to FIGS. 7A, 7B and 7C, the first air valve 3 is retained in the original state, and the second air valve 4. The second upper body 45 of the second air valve 4 rotates with respect to the second lower body 46 to a specific orientation. Air flows into the second air inlet 41, passing through the central space 48 and space 452 to the space 492 and connecting tube 44. At this time, the tubular air cell 12 is inflated and the tubular air cell 11 is not inflated because the connecting tube 43 is communicable to the space 491 and second opening 42.

From above description, in the basic width of the present invention, air can be inflated to or vented from the tubular air cell 11 or tubular air cell 12, or the tubular air cells 11 and 12 are both in the inflation state.

Figure 8B:
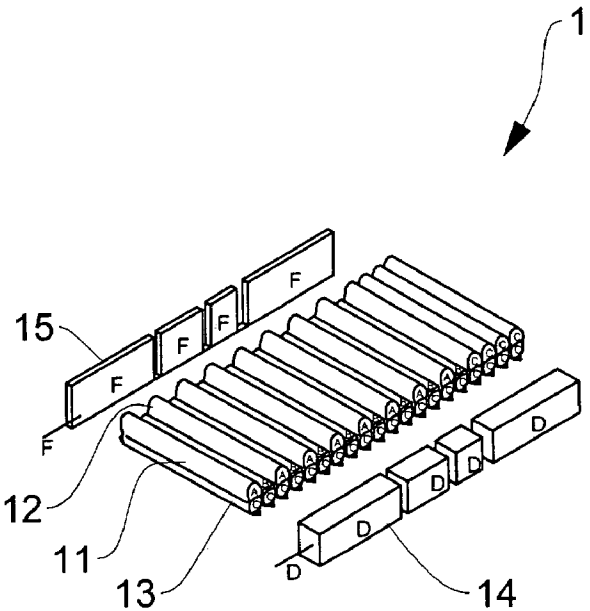
FIG. 8B is a schematic view of the alternating air inflation mattress of FIG. 8A.
Figure 8A:
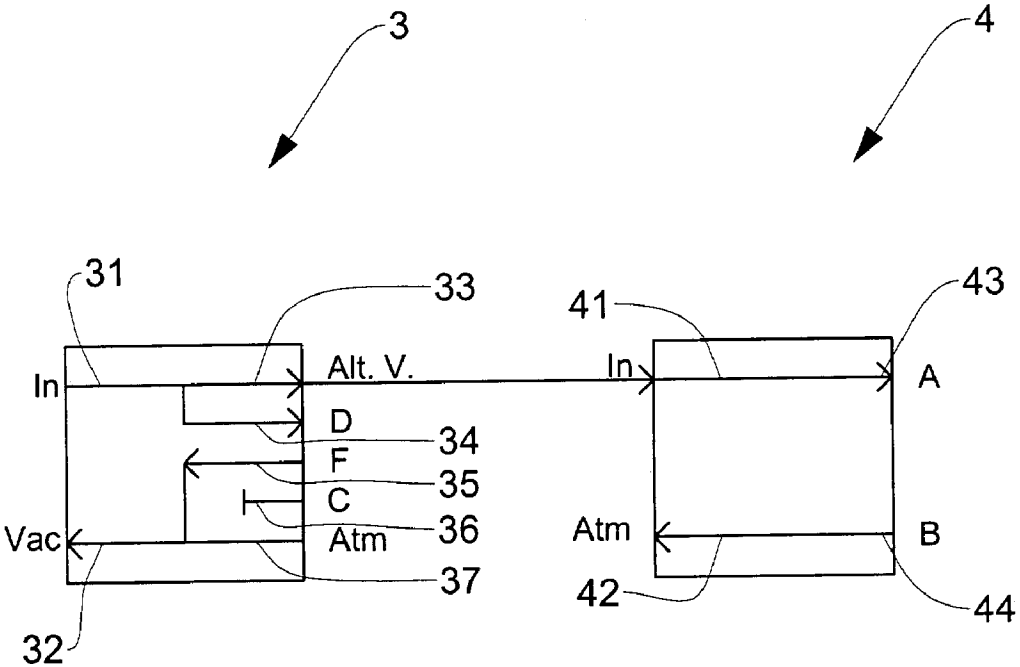
FIG. 8A shows one arrangement, where the tubular air cell 14 of the present invention is inflated for increasing the width of the mattress body.
Figure 8C:
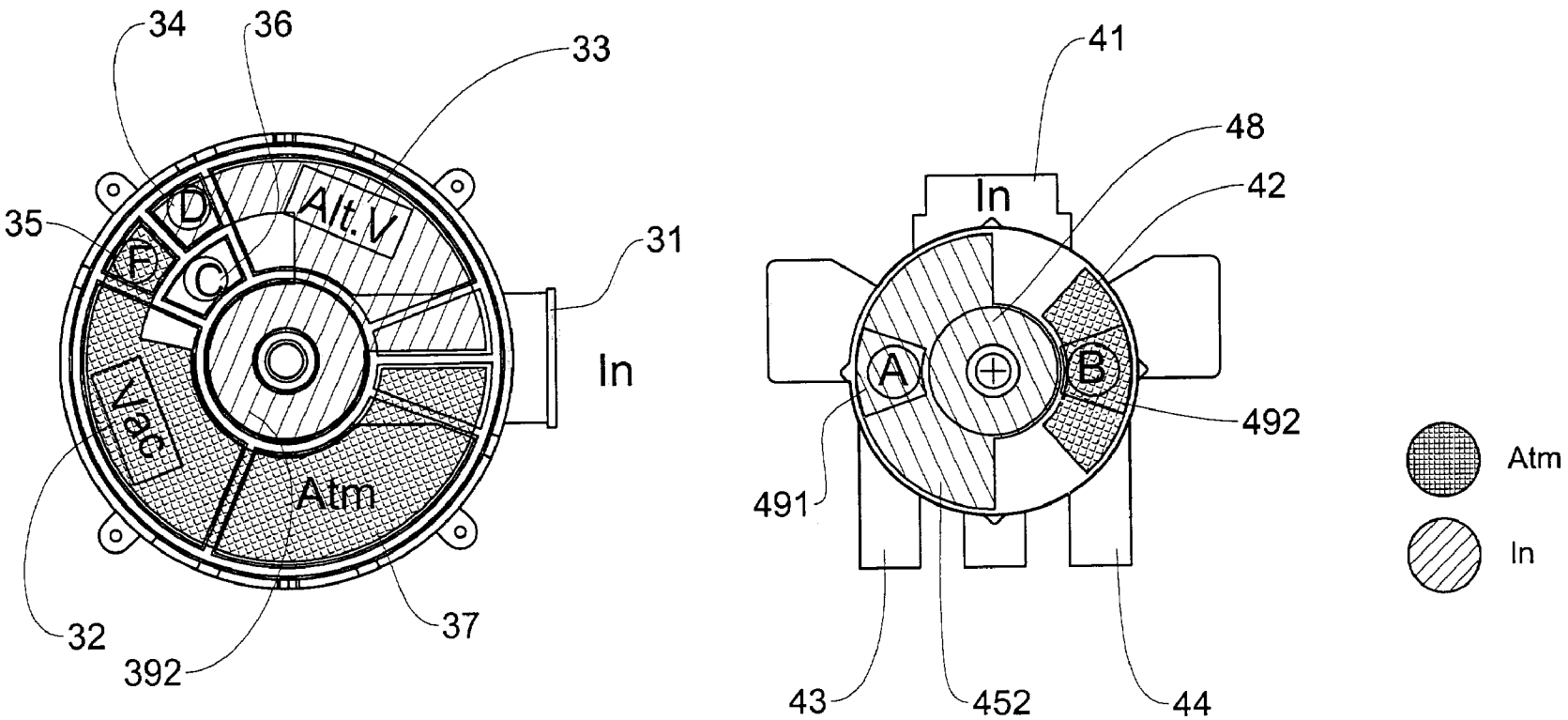
FIG. 8C is a schematic view showing the first air valve and the second air valve of the FIG. 8A.

When it is desired to increase the width of the alternating air inflation mattress, referring to FIGS. 8A, 8B and 8C, the first upper body 38 of the first air valve 3 rotates with respect to the first lower body 39 to a specific orientation as shown in the figures. The air transfer tube 33 is communicable to the first air inlet 31 through the lower central space 392, upper central space 382, and the space 383. The connecting tube 34 is also connected to the space 383 and space 384 so that air in the first air inlet 31 flows into the connecting tube 34 so that the tubular air cell 14 is inflated. Thus, the width of the mattress body 1 includes the tubular air cells 11, 12, 13 and the tubular air cell 14. Apparently, the width of the bed body 1 is increased. As for the connecting tube 35, it is communicable to the air supply opening 32 and the first opening 37 through the space 386 and space 385 so that the tubular air cell 15 is not inflated. As for the second air valve 4, it can inflate, evacuate air in the tubular air cell or retain the air in the tubular air cell.

Figure 9B:
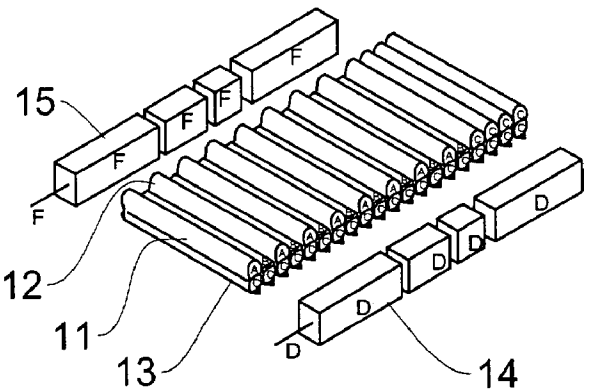
FIG. 9B is a schematic view of the alternating air inflation mattress of FIG. 9A.
Figure 9A:
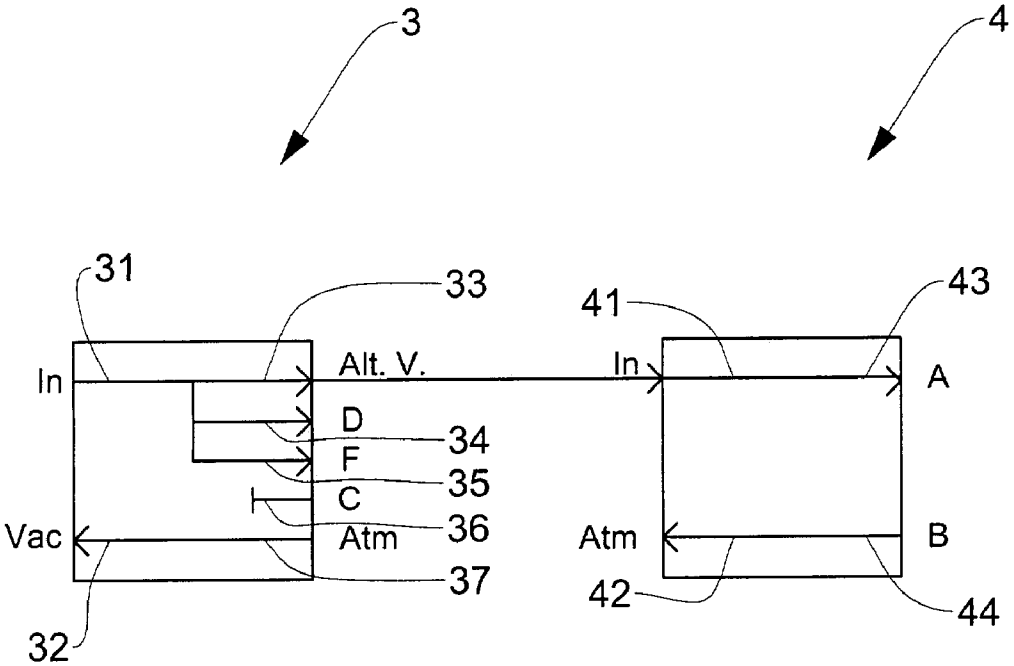
FIG. 9A shows one arrangement, where the tubular air cells 14 and 15 of the present invention is inflated for increasing the width of the mattress body.
Figure 9C:
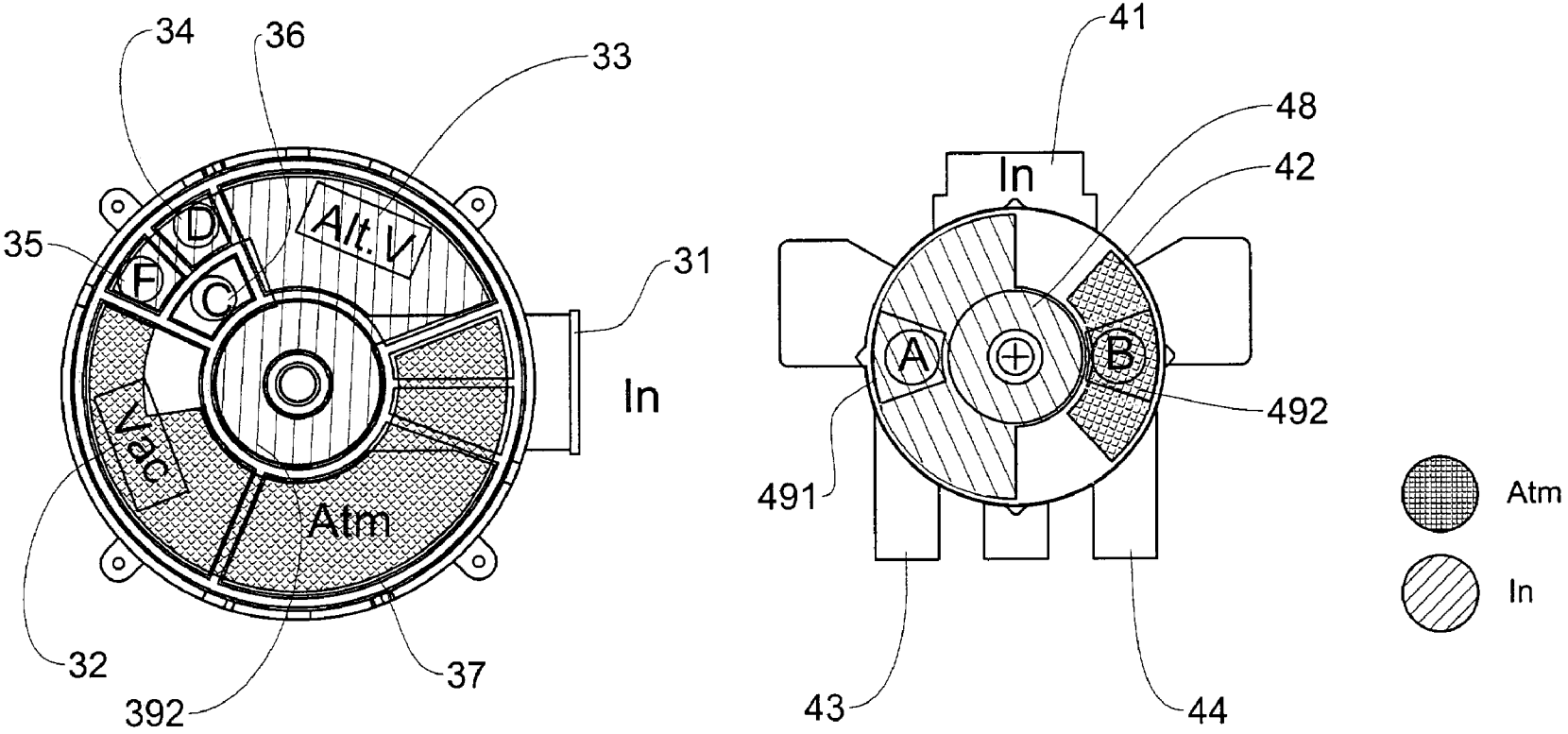
FIG. 9C is a schematic view showing the first air valve and the second air valve of the FIG. 9A.

When it is desired to widen the width of the mattress body 1 to a widest extent, as shown in FIGS. 9A, 9B and 9C, the first upper body 38 of the first air valve 3 rotates with respect to the first lower body 39 to a specific orientation as shown in the drawings. The first air inlet 31 is communicable to the air transfer tube 33 through the lower central space 392, upper central space 382, and space 383. The connecting tubes 34, 35 are communicable to the spaces 383, and 384, respectively so that the air in the first air inlet 31 is transferred to the connecting tubes 34, 35. Thus, the tubular air cells 14 and 15 are both inflated. Thereby, the width of the mattress body 1 includes the tubular air cells 11, 12, 13, 14 and 15.

Figure 10B:
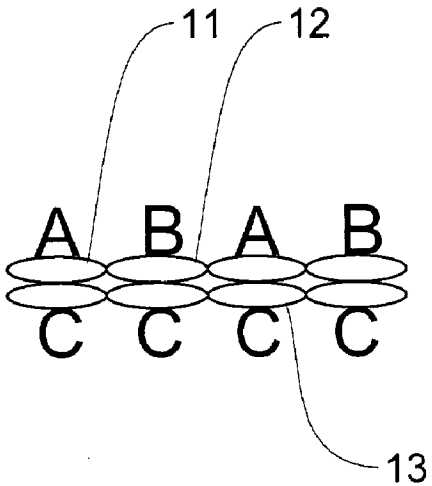
FIG. 10B is a schematic view of the alternating air inflation mattress of FIG. 10
Figure 10A:
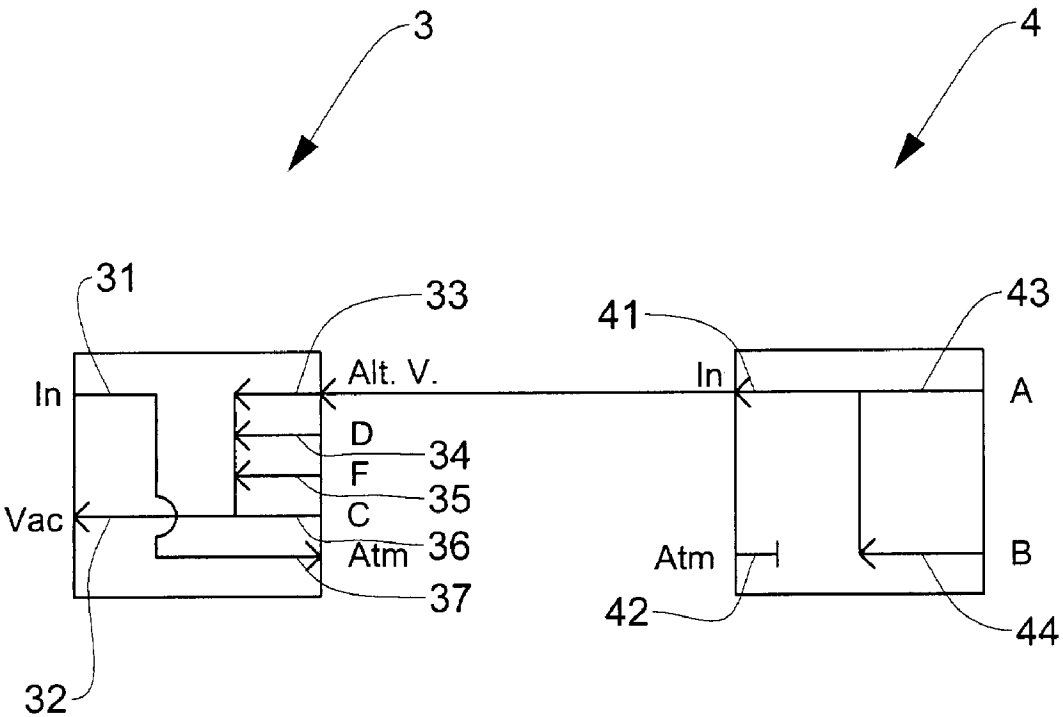
FIG. 10A shows one arrangement, where air in the tubular air cells of the present invention are evacuated.
Figure 10C:
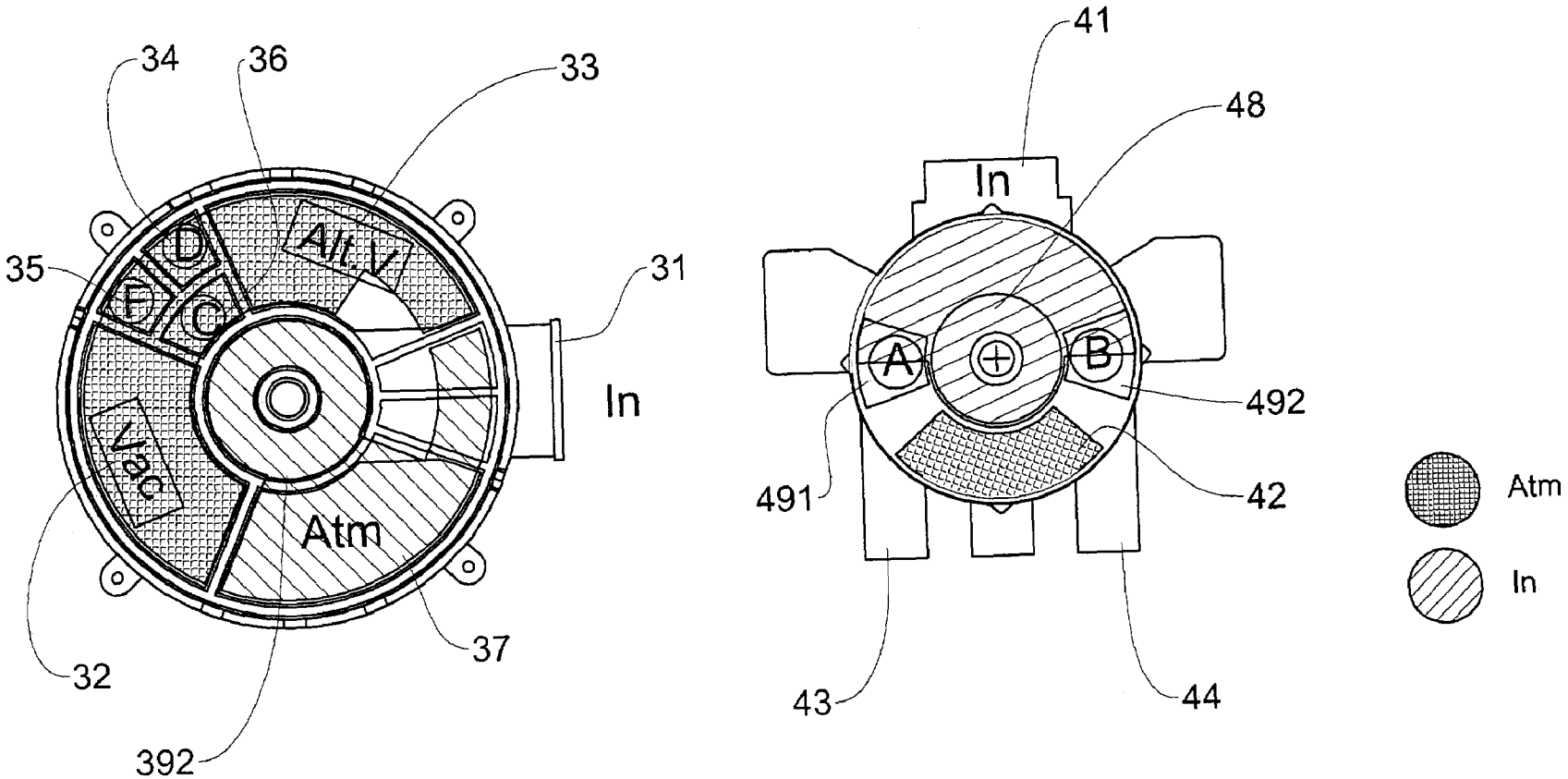
FIG. 10C is a schematic view showing the first air valve and the second air valve of the FIG. 10A.

In emergency, if it is desired to rescue the patient laying upon the mattress 1, the air in the mattress 1 must be released out rapidly for performing CPR. At this time, as shown in FIGS. 10A, 10B and 10C, the first upper body 38 of the first air valve 3 rotates with respect to the first lower body 39 to a specific orientation as shown in the drawings. Then, the first air inlet 31 is communicable to the first opening 37 through the lower central space 392, the upper central space 382 and the space 383. The air is evacuated out. The air transfer tube 33, connecting tubes 34, 35 and 36 are communicable to the air supply opening 32 through the space 385. Since the air supply opening 32 has a suction force, air in the tubular air cells 11, 12, 13, 14 and 15 are sucked out rapidly. Thus air evacuates out and CPR can be performed.

By above-mentioned structure, by the rotation states of the first air valve 3, air in the tubular air cells 15 and 14 can evacuate out separately so as to reduce the width as desired.

Figure 11:
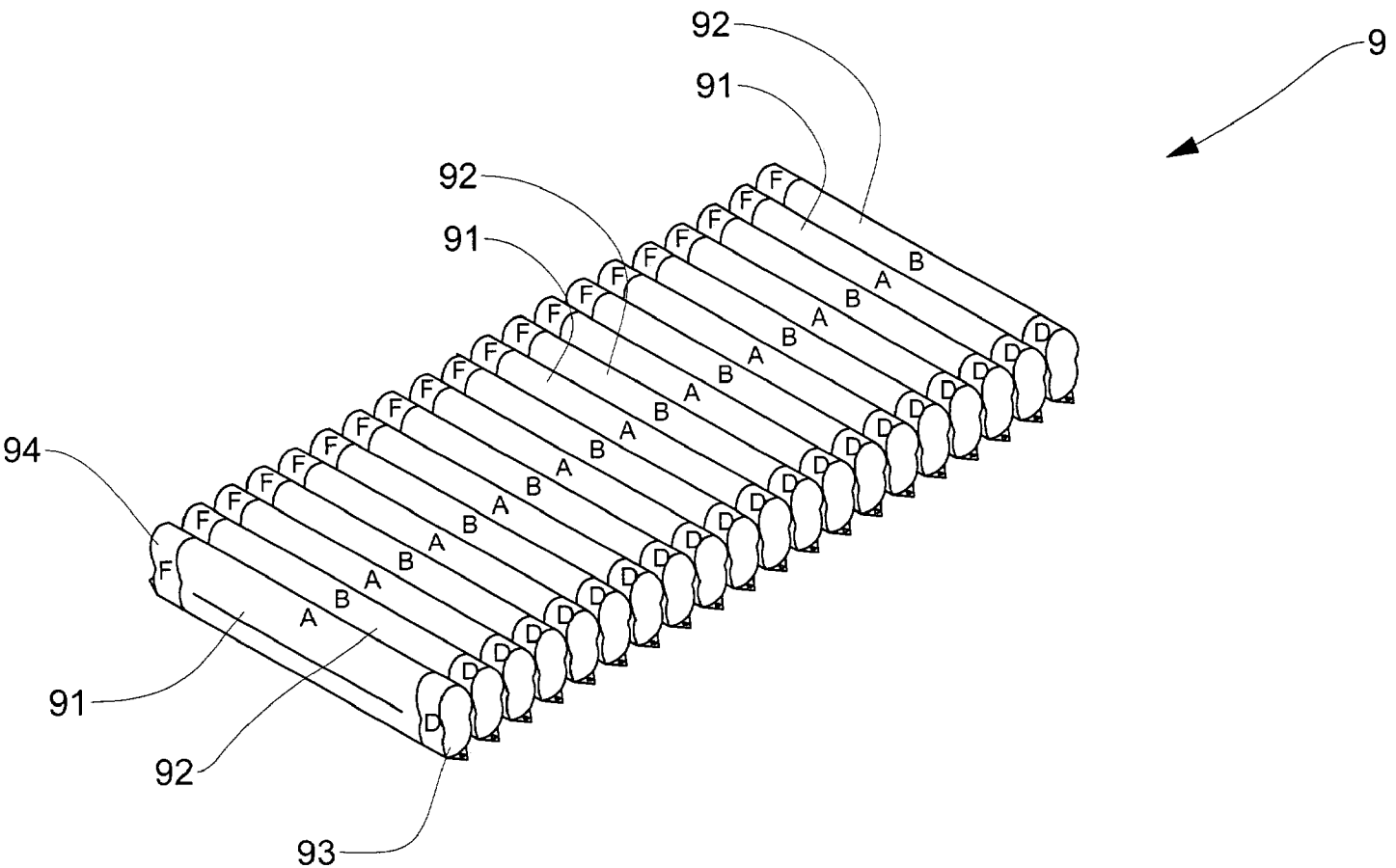
FIG. 11 shows another embodiment of the present invention.

FIG. 11 shows that in the present invention, the mattress body 1 can be formed only by the tubular air cells 91, 92, 93, and 94, the bottom base pad can be neglected. In practical use, it is only necessary to seal the connecting tube 36 of the first air valve 3.

However, the present invention provides a full-featured healthcare mattress system providing a comfortable, pressure reduction environment for the care and management of larger patients. Moreover, the present invention provides an expandable bed having an adjustable width through the expansion of either side or both side lateral air cells to accommodate different larger sized patients. Further, the mattress of present invention allows a bed arranged with the mattress to passage through hospital doors easily and quickly.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A width-adjustable alternating air inflation mattress comprising:

a mattress body having a plurality of first tubular air cells, a plurality of second tubular air cells and a plurality of third tubular air cells which are arranged transversally as a mattress unit; and at least one fourth tubular air cell and at least one fifth tubular air cell being added longitudinally at two opposite sides of the mattress unit forming by the first, second and third tubular air cells;

a pump having air suction and air outlet for pumping air to any one of the tubular air cells;

a first air valve being connected between the mattress body, the pump and a second air valve; the first air valve including a first air inlet, an air supply, an air transfer tube, a first, a second, a third connecting tubes, and a first opening; the first air inlet being connected to the air outlet of the pump; the air supply opening being connected to the air suction; the first connecting tube being connected to the tubular air cells; the second connecting tube being connected to the tubular air cells; the third connecting tube being connected to the tubular air cells; and the first opening being opened;

the second air valve being installed between the first air valve and the mattress body for alternatively inflating and evacuating air in the at least one fourth tubular air cell and the at least one fifth tubular air cell; the second air valve including a second air inlet, a second opening, a fourth connecting tube, a fifth connecting tube; the second air inlet being connected to the air transfer tube; the second opening being opened and the connecting tubes being communicable to the tubular air cells, respectively.

2. The width-adjustable alternating air inflation mattress as claimed in claim 1, wherein the first air valve is formed by a first upper body and a first lower body which are overlapped; an inner surface of the first upper body is formed with an annular edge and a center thereof has a shaft; sealing plates space the second upper body into an upper center space and two other spaces; an edge of the first lower body has an annular edge and a center thereof has a concave space and a lower central space; a first air inlet, an air supply opening; an air transfer tube; a fourth, fifth and sixth connecting tubes; and a first opening; an interior of the first air inlet is communicable to the lower central space.

3. The width-adjustable alternating air inflation mattress as claimed in claim 1, wherein the second air valve is formed by a second upper body and a second lower body which are overlapped to one another; an inner center of the second upper body is formed with a shaft and an edge thereof is formed with a first space and a second opening; the second lower body includes a second air inlet, a fourth connecting tube, a fifth connecting tube, a shaft, a central space, a second space, a third space; an interior of the second air inlet is communicable to the central space; the second space is communicable to the connecting tube; the third space is communicable to the connecting tube.

* * * * *